United States Patent [19]

Slater et al.

[11] 4,362,485

[45] Dec. 7, 1982

[54] APPARATUS FOR CONTINUOUS EXTRUSION

[75] Inventors: Harold K. Slater; James Duckworth, both of Preston, England

[73] Assignee: United Kingdom Atomic Energy Authority, London, England

[21] Appl. No.: 264,099

[22] Filed: May 15, 1981

[30] Foreign Application Priority Data

Jun. 10, 1980 [GB] United Kingdom ..... 8018943

[51] Int. Cl.[3] ..... B21C 23/21

[52] U.S. Cl. ..... 425/79; 72/60; 72/261; 72/262; 425/190; 425/224; 425/374; 425/376 B; 425/378 R

[58] Field of Search ..... 425/376 R, 374, 376 B, 425/224, 185, 190, 79, 192 R, 378 R; 72/60, 261, 262, 273

[56] References Cited

U.S. PATENT DOCUMENTS

| | | | |
|---|---|---|---|
| 3,153,688 | 10/1964 | Marshall | 425/192 R |
| 3,765,216 | 10/1973 | Green | 425/374 |
| 3,872,703 | 3/1975 | Green | 72/262 |
| 4,044,587 | 8/1977 | Green et al. | 425/374 |
| 4,101,253 | 7/1978 | Etherington | 425/224 |
| 4,111,023 | 9/1978 | Moreau | 425/224 |
| 4,142,805 | 3/1979 | Tadmor | 425/376 B |
| 4,163,377 | 8/1979 | Moreau | 425/224 |
| 4,277,968 | 7/1981 | Pardoe | 72/262 |

*Primary Examiner*—Jeffery R. Thurlow
*Attorney, Agent, or Firm*—William R. Hinds

[57] ABSTRACT

Apparatus for continuous extrusion has a rotatable wheel with an endless groove therein, a relatively stationary shoe member overlying part of the groove lengthwise, a portion of the shoe member projecting part way into the groove and being constituted at least partly by a die assembly which includes a separate and replaceable abutment member which projects into the groove to block it. The die assembly can have separate and replaceable components constituting a feed chamber, a die throat, and optionally a mandrel supported in the die throat for producing tubular extrusion products. Cooling of the die assembly is also envisaged.

7 Claims, 8 Drawing Figures

APPARATUS FOR CONTINUOUS EXTRUSION

BACKGROUND TO THE INVENTION

This invention relates to apparatus for the performance of continuous extrusion of feedstock materials. The materials involved may be metals or alloys, cermets, ceramics, plastics or any other materials which are extrudable. The form of feed of the material may be solid, particulate, including powder, granules, spheroids etc, swarf, turnings, slicings, off-cuts, scrap or any other form capable of being compacted into a form and condition allowing extrusion.

A process and apparatus for continuous extrusion is described in commonly owned U.S. Pat. No. 3,765,216, particularly the apparatus described with reference to FIG. 3 thereof. FIGS. 5–9 thereof show various embodiments of the shoe 4 of FIG. 3; in such FIGS. 5–9 various forms of die or dies 6 are shown incorporated in the material of shoe 4. Commonly owned subsequently filed U.S. Pat. No. 3,872,703 discloses, in FIGS. 1 and 2 thereof, the shoe 4 having a removable insert member 6 secured in the shoe 4, the insert member 6 being made and dimensioned so as to have a portion which projects into the endless groove 3 in the wheel 1 of the extrusion apparatus, the relative position of the insert member 6 within the groove 3 being adjustable in the depth sense.

The present invention is concerned with a practical form of die means for production of, for example, tubing, by continuous extrusion as aforesaid, and involved with and incorporated in an assembly of shoe member (including a portion which projects into the wheel groove as aforesaid) and abutment, the latter serving to block the endless groove and cause upsetting of the feed material and extrusion through the die means.

SUMMARY OF THE INVENTION

According to the invention, continuous extrusion apparatus has a rotatable wheel with an endless groove therein, a relatively stationary shoe member overlying part of the groove lengthwise and having a portion projecting part way into said groove, and a die assembly replaceably incorporated in said shoe member so as to provide at least a part of the projecting portion thereof and to also provide an abutment member which projects into and blocks said groove, whereby feedstock material fed to the passageway formed by the shoe member projecting portion and that part of the groove into which it projects and with which it cooperates, is caused by the force generated by friction between the groove floor and sides and the feedstock material on rotation of said wheel and by the presence of said abutment which blocks one end of said passageway, to become upset and to be extruded through die means of the die assembly.

The die assembly preferably includes a feed chamber in communication with said passageway and the die means, whereby upset feedstock from said passageway collects in said feed chamber before passing to the die means, together with a separate die throat communicating with said feed chamber and with or without a mandrel supported within the die throat to provide tubular products on extrusion.

The abutment member may be separate from and replaceable in, said die assembly. Furthermore, annular members constituting the feed chamber and die throat are preferably provided and accommodated adjacent one another in an aperture in a body of the die assembly, said aperture extending from the said projecting portion of the die assembly whence it is in communication with said passageway.

Means for conducting coolant in contact with the die assembly are preferably provided.

The invention also includes die means for incorporation in continuous extrusion apparatus of the kind referred to.

DESCRIPTION OF THE DRAWINGS

A constructional embodiment of the invention will now be described with reference to the accompanying drawings, FIGS. 1 and 2 of which correspond to FIGS. 1 and 2 of U.S. Pat. No. 3,872,703 (such FIG. 1 being in structure virtually identical with the said FIG. 3 of U.S. Pat. No. 3,765,216), wherein FIGS. 1 and 2 correspond to FIGS. 1 and 2 of U.S. Pat. No. 3,872,703, and show continuous extrusion apparatus, FIG. 1 being a side view partially sectioned and FIG. 2 being a detached section line II—II of FIG. 1.

DESCRIPTION OF THE PREFERRED EMBODIMENT

Figure 1:
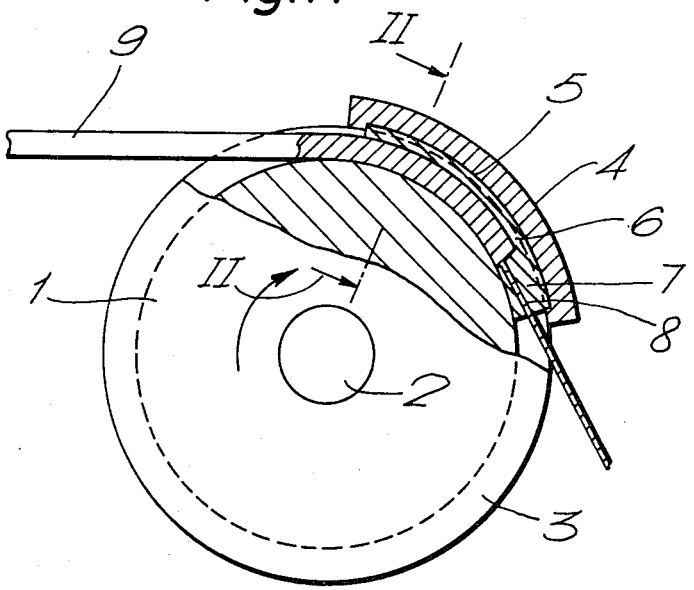
Figure 2:
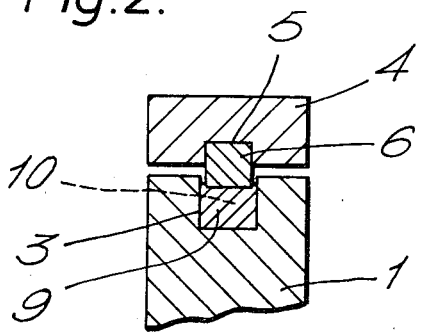

Referring firstly to FIGS. 1 and 2 which, corresponding to FIGS. 1 and 2 of U.S. Pat. No. 3,872,703, illustrate diagrammatically a continuous extrusion apparatus which will be described to the extent only of permitting understanding of the basic structure and principles of operation, we provide a horizontally disposed driven shaft 2 on which a wheel 1 is secured for driven rotation therewith, the wheel 1 having an endless groove 3 which in this embodiment is peripheral and of square-section and into which projects an insert member 6 carried removably and replaceably in a recess 5 in a shoe member 4 which is relatively stationary and which overlies a portion of the periphery of the wheel 1. The insert member 6 projects into the groove 3 depthwise, and the shoe member 4 has an abutment member which forms a termination of the insert member 6 and can be integral therewith or separate therefrom, the abutment member 7 extending the full depth of the groove 3 and thereby blocking it, and the remainder of the insert member 6 projecting depthwise (with adjustable amount of projection) into the groove 3 with minimum penetration, see FIG. 2, thereby forming a passageway 10 indicated by a dotted line in FIG. 2 and defined by the floor and sides of the groove and the lower surface of the insert member 6. The abutment member 7 closes one end of the passageway 10 and the other end, the feed end, is open for the reception of the feed material. There is a die orifice 8 formed through the abutment member 7.

In operation, the shaft 2 is rotated in the direction shown by the arrow in FIG. 1, and material such as a round metal rod 9 is fed to the groove 3 in which the rod is an interference fit, enters the open end of the passageway 10, the friction generated between the rod and the two groove sides (the sliding of the surface of insert member 6 over the rod 9 cancels out the frictional force generated between the rod 9 and the groove floor)

causes upsetting of the material and deforms it to the cross-sectional shape of the groove 3 (see FIG. 2) and finally causes the deformed and upset material to be extruded through the die orifice 8.

Figure 3:
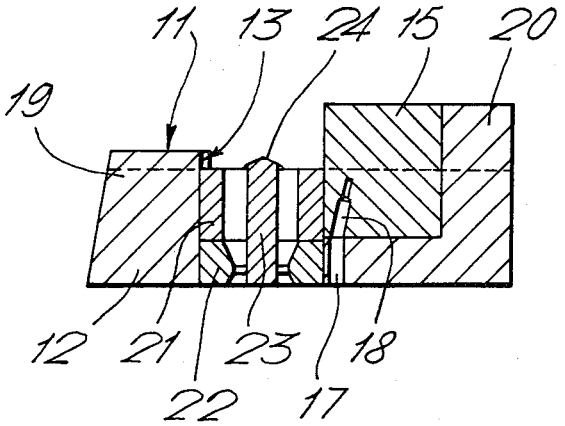
FIG. 3 is a side view in medial section of a die means assembly in accordance with the invention.
Figure 4:
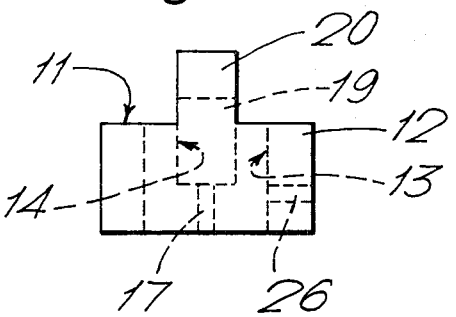
FIGS. 4 and 5 are an end view and a plan view respectively of FIG. 3, FIGS. 6 and 7 are side views of details.
Figure 5:
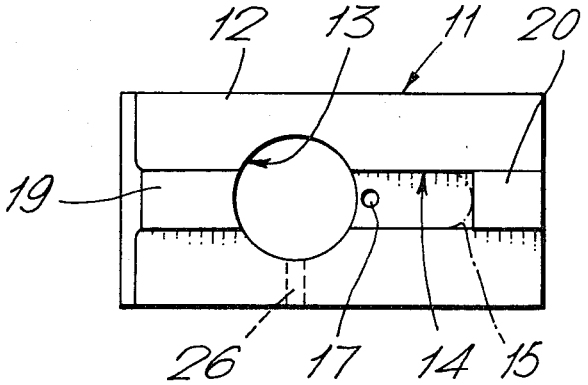

The foregoing explains the basic structure and principles of operation of the continuous extrusion apparatus. Solid feed can be replaced by particle, scrap or other forms of material, e.g. for recycling or recovery. Hereafter, improvement features according to the invention to be applied to the continuous extrusion apparatus just described will be dealt with, with reference to FIGS. 3–8. Referring firstly to FIGS. 3–5, an assembled die means or assembly 11 includes a die body 12, which corresponds to at least a part of the insert member 6 of FIGS. 1 and 2 and which is carried releasably and replaceably in a recess in a shoe member (not shown, but corresponding to the recess 5 and shoe member 4 of FIGS. 1 and 2) of a continuous extrusion apparatus of the type shown in FIGS. 1 and 2. It will be appreciated however that the die means assembly shown in FIG. 3 would be positioned so that the lower portion as shown in FIG. 3 would be engaged in the recess 5 in the shoe member 4 with the upper portion projecting therefrom in the direction of the wheel axis. The die body 12 has an aperture 13 and a slot 14 extending laterally therefrom and in which is accommodated a replaceable abutment member 15 which corresponds to the abutment member 7 of the apparatus shown in FIGS. 1 and 2. The slot 14 terminates in an end with which a rounded side of the abutment member 15 engages, see FIG. 5. The base of the slot 14 has a drilling 17 which registers with a blind hole 18 in the abutment member 15 provided either for conducting coolant to the abutment member 15 or for accommodation of a thermocouple (not shown) for monitoring purposes. That side 19 of the die body 12 opposed to the slot 14 which accommodates the abutment member 15 and which corresponds to side 20 of the body 12, is of less height than that of the side 20 and of the abutment member 15. The side 20 serves also to support the abutment member in its passageway-blocking position during operation.

Figure 6:
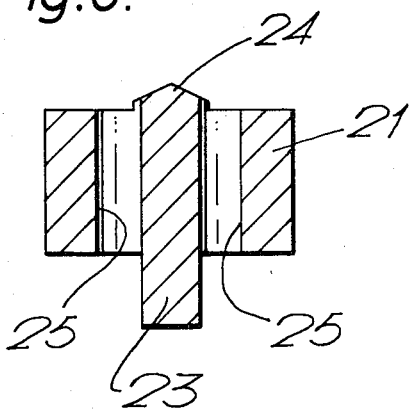
Figure 7:
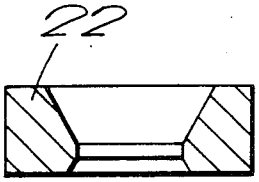
Figure 8:
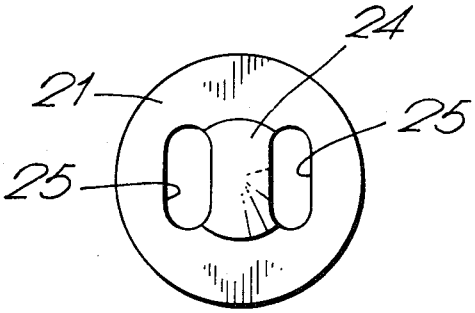
FIG. 8 is a plan view of FIG. 6.

The aperture 13 accommodates a die feed chamber member 21 and die throat member 22, shown assembled in FIG. 3 and in more detail and to a larger (twice) scale in FIGS. 6 and 8 and FIG. 7 respectively. A mandrel 23 (FIGS. 3 and 6) is disposed centrally in the feed chamber constituted by member 21 and the throat of member 22, being carried from a bridge piece 24 which spans across cut-aways 25 to enable upset feed material from the passageway corresponding to passageway 10 of FIG. 2 to reach and fill the feed chamber and to surround the mandrel 23. The surface of the bridge piece 24 which forms the top of the mandrel 23 is shaped with inclinations of the order of 25° to the horizontal, to assist in diverting upset feed material to divide and flow into the feed chamber and rejoin to flow in the annulus formed by the complete periphery of the mandrel 23 and of the die throat, thereby forming a tubular product. If a solid product is required, the mandrel 23 and bridge piece 24 can be omitted. Furthermore if a shaped-section product is required, a die throat of the appropriate shape (FIGS. 3 and 7 show a cylindrical shape) is provided.

In operation, the side 19 of the die body 12 is mounted in the recess of the shoe member so that another part of the shoe member abuts side 19 and continues the reduced width part which projects (as in FIG. 2) into the groove of the wheel of the continuous extrusion apparatus, the groove width being slightly more than the width of both the said projecting parts and the abutment member 15 so as to allow rotation of the wheel with the shoe member and its inserts remaining stationary. The abutment member 15 supported by the side 20 of the body 12, substantially blocks the groove of the wheel, whilst the other projecting parts form, with the sides and floor of the wheel groove, the said passageway for feed material. The die means is formed just in advance of the abutment member 15 and receives upset feed material from the passageway and produces an extruded product, there being provision in the remainder of the shoe member for product to pass outwardly radially relative to the wheel.

The die body 12 also has a drilling 26 (FIG. 4) between the aperture 13 and the side of the body 12. The drilling 26 may be arranged to be in communication with cooling fluid ducts in the remainder of the shoe member, or may accommodate a thermocouple for die temperature monitoring.

The die means according to the invention is particularly suitable for use with copper feedstock to produce copper rod, wire or tubing, but may also be employed to produce products in other suitable metals, such as aluminium and aluminium alloys. In these latter materials shaped sections for architectural purposes such as door and window frames, are typical examples.

Wear typically takes place at the die throat, at the mandrel, where provided, in the feed chamber, and at the abutment. It is advantageous that all the components which constitute these items are replaceable. Wear also takes place at the top of side 19 of the die body 12. Compensation for such wear can be made by adjustment of the position depthwise of the body 12 in the recess in the shoe member, and in the ultimate, the die body 12 can be replaced without the necessity to change the shoe member, which is itself adjustable depthwise relative to the floor of the wheel groove.

We claim:

1. Continuous extrusion apparatus comprising a rotatable wheel with an endless groove therein, a relatively stationary shoe member overlying part of said groove lengthwise and having a portion projecting part way into said groove, a die assembly removably and replaceably incorporated as an assembly in said shoe member so as to provide at least a part of the projecting portion thereof, a removable and replaceable abutment member formed by a removable and replaceable part of said die assembly, said abutment member projecting into and blocking said groove, removable and replaceable die means forming part of said die assembly, and fluid coolant passage means for effecting cooling of said die assembly and its parts, whereby feedstock material fed to the passageway formed by said shoe member projecting portion and that part of said groove into which it projects and with which it cooperates is caused by the force generated by friction between the groove floor and sides of the feedstock material on rotation of said wheel and by the presence of said abutment which blocks one end of said passageway, to become upset and to be extruded through said die means of said die assembly.

2. Continuous extrusion apparatus according to claim 1, wherein the die assembly includes a removable and replaceable insert defining a feed chamber in communication with said passageway and said die means, whereby upset feedstock collects in said feed chamber from said passageway before passing to said die means.

3. Continuous extrusion apparatus according to claim 2, wherein said die means includes a removable and replaceable insert forming a separate die throat in communication with said feed chamber.

4. Continuous extrusion apparatus according to claim 2, wherein said die assembly includes a die body having an aperture, and said feed chamber is formed by an annular insert member accommodated in said aperture in the body of the die assembly, the said aperture extending from said projecting portion of the die assembly where it is in communication with said passageway.

5. Continuous extrusion apparatus according to claim 4, wherein said die throat is formed in and by an annular insert member and is disposed in said aperture of said die body in a position adjacent the annular member which constitutes said feed chamber.

6. Apparatus as claimed in claim 1 wherein said die assembly includes a unitary removable and replaceable die body having, considered in the direction of rotation of said wheel, a first portion projecting partway into said groove and a second portion spaced from said first portion and projecting further into said groove, an aperture opening into said groove and located between said first and second portions relatively adjacent said first portion and containing said removable and replaceable die means, and a slot formed in said die body between said aperture and said second portion and opening toward said groove, said abutment member having its base removably disposed in said slot and projecting outwardly therefrom into said groove, and abutting its rearward face against the forward face of said second portion.

7. Apparatus as claimed in claim 6 wherein said fluid coolant passage means includes interconnecting passages formed in said die body and said abutment member, and adapted for connection with a supply of fluid coolant.

* * * * *